US010334359B2

(12) United States Patent
Fishman et al.

(10) Patent No.: US 10,334,359 B2
(45) Date of Patent: Jun. 25, 2019

(54) LOW-NOISE DRIVER AND LOW-NOISE RECEIVER FOR SELF-MIX MODULE

(71) Applicant: VocalZoom Systems Ltd., Yokneam Illit (IL)

(72) Inventors: Tal Fishman, Haifa (IL); Alexander Blumkin, Nazareth Illit (IL); Guy Ofek, Shimshit (IL); Eytan Keydar, Rehovot (IL); Tal Bakish, Modi'in (IL)

(73) Assignee: VOCALZOOM SYSTEMS LTD., Yokneam Illit (IL)

( * ) Notice: Subject to any disclaimer, the term of this patent is extended or adjusted under 35 U.S.C. 154(b) by 0 days.

(21) Appl. No.: 15/511,642

(22) PCT Filed: Jul. 25, 2016

(86) PCT No.: PCT/IB2016/054416
§ 371 (c)(1),
(2) Date: Mar. 16, 2017

(87) PCT Pub. No.: WO2017/017592
PCT Pub. Date: Feb. 2, 2017

(65) Prior Publication Data

US 2018/0234761 A1 Aug. 16, 2018

Related U.S. Application Data

(60) Provisional application No. 62/197,023, filed on Jul. 26, 2015, provisional application No. 62/197,106, (Continued)

(51) Int. Cl.
*H04R 3/00* (2006.01)
*H04R 17/02* (2006.01)
(Continued)

(52) U.S. Cl.
CPC ..... *H04R 3/005* (2013.01); *G10L 21/0216* (2013.01); *H04R 17/02* (2013.01);
(Continued)

(58) Field of Classification Search
USPC ..... 381/13, 71.1, 73.1, 94.1, 94.5, 119, 317, 381/355
See application file for complete search history.

(56) References Cited

U.S. PATENT DOCUMENTS 6,323,943 B1 11/2001 Maruyama et al.
7,775,113 B2 8/2010 Bakish
(Continued)

FOREIGN PATENT DOCUMENTS

WO WO2014068552 5/2014

OTHER PUBLICATIONS

International Search Report for application PCT/IB2016/054416 dated Nov. 2, 2016.

*Primary Examiner* — Yosef K Laekemariam
(74) *Attorney, Agent, or Firm* — Eitan Mehulal Sadot

(57) ABSTRACT

Optical microphone, laser-based microphone, and laser microphone having reduced-noise components of low-noise components. A laser microphone comprises a laser-diode associated with a low-noise laser driver TX; and a photo-diode associated with a low-noise photo-diode receiver RX. The low-noise laser driver TX supplies a drive current which is a combination of a Direct Current component having a first bandwidth, and an attenuated version of an Alternating Current component having a second, different, bandwidth. Additionally or alternatively, the low-noise photo-diode receiver RX utilizes hardware-based demodulation of the analog signal, and operates to remove a Direct Current component of its output signal prior to digitization.

24 Claims, 9 Drawing Sheets

Related U.S. Application Data filed on Jul. 27, 2015, provisional application No. 62/197,107, filed on Jul. 27, 2015, provisional application No. 62/197,108, filed on Jul. 27, 2015.

(51) Int. Cl.

| | |
|---|---|
| ***H04R 19/04*** | (2006.01) |
| ***H04R 23/00*** | (2006.01) |
| ***H04R 23/02*** | (2006.01) |
| ***G10L 21/0216*** | (2013.01) |

(52) U.S. Cl.

CPC ..... *H04R 19/04* (2013.01); *H04R 23/008* (2013.01); *H04R 23/02* (2013.01); *H04R 2410/05* (2013.01); *H04R 2499/11* (2013.01); *H04R 2499/13* (2013.01); *H04R 2499/15* (2013.01)

(56) References Cited

U.S. PATENT DOCUMENTS

| | | | | |
|---|---|---|---|---|
| 8,286,493 | B2 * | 10/2012 | Bakish | G01H 9/00 73/596 |
| 8,692,979 | B2 | 4/2014 | Moench et al. | |
| 8,949,118 | B2 | 2/2015 | Avargel et al. | |
| 9,344,811 | B2 | 5/2016 | Bakish | |
| 2002/0125324 | A1 | 9/2002 | Yavid et al. | |
| 2006/0274906 | A1 * | 12/2006 | Jia | G06F 3/0433 381/119 |
| 2013/0223571 | A1 * | 8/2013 | Dark | H04B 1/0028 375/340 |

* cited by examiner

LOW-NOISE DRIVER AND LOW-NOISE RECEIVER FOR SELF-MIX MODULE

CROSS-REFERENCE TO RELATED APPLICATIONS

This patent application is a National Stage of PCT International Application number PCT/IB2016/054416, having an International Filing Date of Jul. 25, 2016, published as International Publication number WO 2017/017592, which is hereby incorporated by reference in its entirety; which claims priority and benefit from U.S. provisional patent application No. 62/197,023, filed on Jul. 26, 2015, which is hereby incorporated by reference in its entirety.

The above-mentioned PCT international application number PCT/IB2016/054416 also claims priority and benefit from U.S. provisional patent application No. 62/197,106, filed on Jul. 27, 2015, which is hereby incorporated by reference in its entirety.

The above-mentioned PCT international application number PCT/IB2016/054416 also claims priority and benefit from U.S. provisional patent application No. 62/197,107, filed on Jul. 27, 2015, which is hereby incorporated by reference in its entirety.

The above-mentioned PCT international application number PCT/IB2016/054416 also claims priority and benefit from U.S. provisional patent application No. 62/197,108, filed on Jul. 27, 2015, which is hereby incorporated by reference in its entirety.

FIELD

The present invention is related to processing of signals.

BACKGROUND

Audio and acoustic signals are captured and processed by millions of electronic devices. For example, many types of smartphones, tablets, laptop computers, and other electronic devices, may include an acoustic microphone able to capture audio. Such devices may allow the user, for example, to capture an audio/video clip, to record a voice message, to speak telephonically with another person, to participate in telephone conferences or audio/video conferences, to verbally provide speech commands to a computing device or electronic device, or the like.

SUMMARY

The present invention may include, for example, systems, devices, and methods for enhancing and processing audio signals, acoustic signals and/or optical signals.

The present invention may include an optical microphone, laser-based microphone, and laser microphone having reduced-noise components of low-noise components. For example, a laser microphone comprises a laser-diode associated with a low-noise laser driver TX; and a photo-diode associated with a low-noise photo-diode receiver RX. The low-noise laser driver TX supplies a drive current which is a combination of a Direct Current component having a first bandwidth, and an attenuated version of an Alternating Current component having a second, different, bandwidth. Additionally or alternatively, the low-noise photo-diode receiver RX utilizes hardware-based demodulation of the analog signal, and operates to remove a Direct Current component of its output signal prior to digitization.

The present invention may provide other and/or additional benefits or advantages.

BRIEF DESCRIPTION OF THE DRAWINGS

The present invention may provide other and/or additional benefits or advantages.

DETAILED DESCRIPTION OF THE PRESENT INVENTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Applicants have realized that an optical microphone, or a laser-based microphone, may be utilized in order to enhance or improve the acoustic signal that is captured by an acoustic microphone, or in order to reduce noise from such acoustic signal, or in order to separate or differentiate among multiple sources of acoustic signal(s), in one or more ways as described herein.

Figure 1:
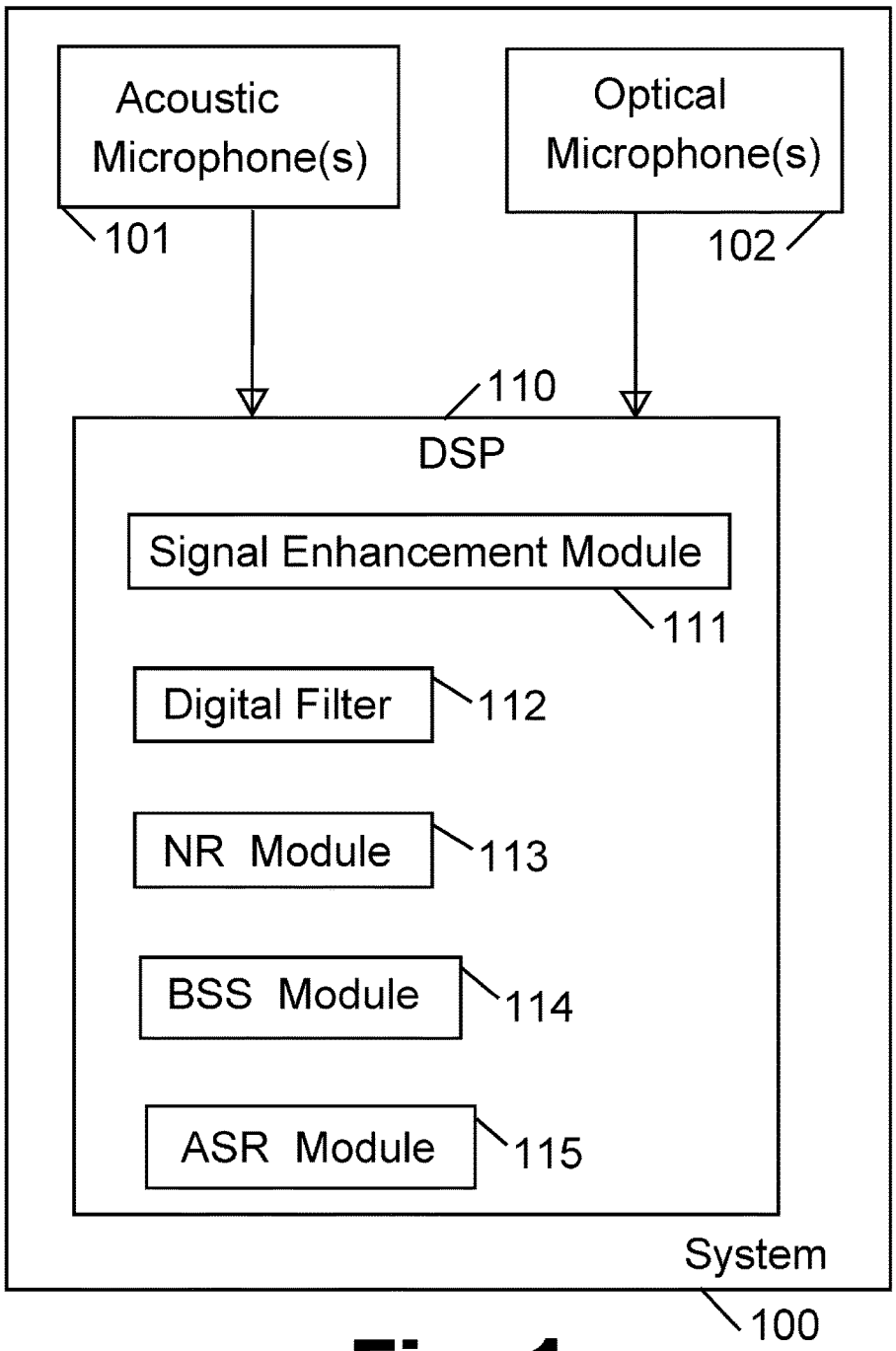
FIG. 1 is a schematic block-diagram illustration of a system, in accordance with some demonstrative embodiments of the present invention.

Reference is made to FIG. 1, which is a schematic block-diagram illustration of a system 100 in accordance with some demonstrative embodiments of the present invention. System 100 may be implemented as part of, for example: an electronic device, a smartphone, a tablet, a gaming device, a video-conferencing device, a telephone, a vehicular device, a vehicular system, a vehicular dashboard device, a navigation system, a mapping system, a gaming system, a portable device, a non-portable device, a computer, a laptop computer, a notebook computer, a tablet computer, a server computer, a handheld device, a wearable device, an Augmented Reality (AR) device or helmet or glasses or headset (e.g., similar to Google Glass), a Virtual Reality (VR) device or helmet or glasses or headset (e.g., similar to Oculus Rift), a smart-watch, a machine able to receive voice commands or speech-based commands, a speech-to-text converter, a Voice over Internet Protocol (VoIP) system or device, wireless communication devices or systems, wired communication devices or systems, image processing and/or video processing and/or audio processing workstations or servers or systems, electro-encephalogram (EEG) systems, medical devices or systems, medical diagnostic devices and/or systems, medical treatment devices and/or systems, and/or other suitable devices or systems. In some embodiments, system 100 may be implemented as a stand-alone unit or "chip" or module or device, able to capture audio and able to output enhanced audio, clean audio, noise-reduced audio, or otherwise improved or modified audio. System 100 may be implemented by utilizing one or more hardware components and/or software modules.

System 100 may comprise, for example: one or more acoustic microphone(s) 101; and one or more optical microphone(s) 102. Each one of the optical microphone(s) 102 may be or may comprise, for example, a laser-based microphone; which may include, for example, a laser-based transmitter (for example, to transmit a laser beam, e.g., towards a face or a mouth-area of a human speaker or human user, or towards other area-of-interest), an optical sensor to capture optical feedback returned from the area-of-interest; and an optical feedback processor to process the optical feedback and generate a signal (e.g., a stream of data; a data-stream; a data corresponding or imitating or emulating n audio signal or an acoustic signal) that corresponds to that optical feedback.

The acoustic microphone(s) 101 may acquire or sense or capture one or more acoustic signal(s); and the optical microphone(s) 102 may acquire or sense or capture one or more optical signal(s). The signals may be utilized by a digital signal processor (DSP) 110, or other controller or processor or circuit or Integrated Circuit (IC). For example, the DSP 110 may comprise, or may be implemented as, a signal enhancement module 111 able to enhance or improve the acoustic signal based on the receives signal; a digital filter 112 (e.g., a digital comb filter, a linear filter, a non-linear filter, or other suitable type of filter; which may be a separate unit, or may be part of the signal enhancement module 111) which may be able to filter the acoustic signal based on the received signals; a Noise Reduction (NR) module 113 able to reduce noise from the acoustic signal based on the received signals; a Blind Source Separation (BSS) module 114 able to separate or differentiate among two or more sources of audio, based on the receives signals; a Speech Recognition (SR) or Automatic Speech Recognition (ASR) module 115 able to recognize spoken words based on the received signals; and/or other suitable modules or sub-modules.

In the discussion herein, the output generated by (or the signals captured by, or the signals processed by) an Acoustic microphone, may be denoted as "A" for Acoustic.

In the discussion herein, the output generated by (or the signals captured by, or the signals processed by) an Optical (or laser-based) microphone, may be denoted as "O" for Optical.

Although portions of the discussion herein may relate to, and although some of the drawings may depict, a single acoustic microphone, or two acoustic microphones, it is clarified that these are merely non-limiting examples of some implementations of the present invention. The present invention may be utilized with, or may comprise or may operate with, other number of acoustic microphones, or a batch or set or group of acoustic microphones, or a matrix or array of acoustic microphones, or the like.

Although portions of the discussion herein may relate to, and although some of the drawings may depict, a single optical (laser-based) microphone, or two optical (laser-based) microphones, it is clarified that these are merely non-limiting examples of some implementations of the present invention. The present invention may be utilized with, or may comprise or may operate with, other number of optical or laser-based microphones, or a batch or set or group of optical or laser-based microphones, or a matrix or array of optical or laser-based microphones, or the like.

Although portions of the discussion herein may relate, for demonstrative purposes, to two "sources" (e.g., two users, or two speakers, or a user and a noise, or a user and interference), the present invention may be used in conjunction with a system having a single source, or having two such sources, or having three or more such sources (e.g., one or more speakers, and/or one or more noise sources or interference sources).

Figure 2:
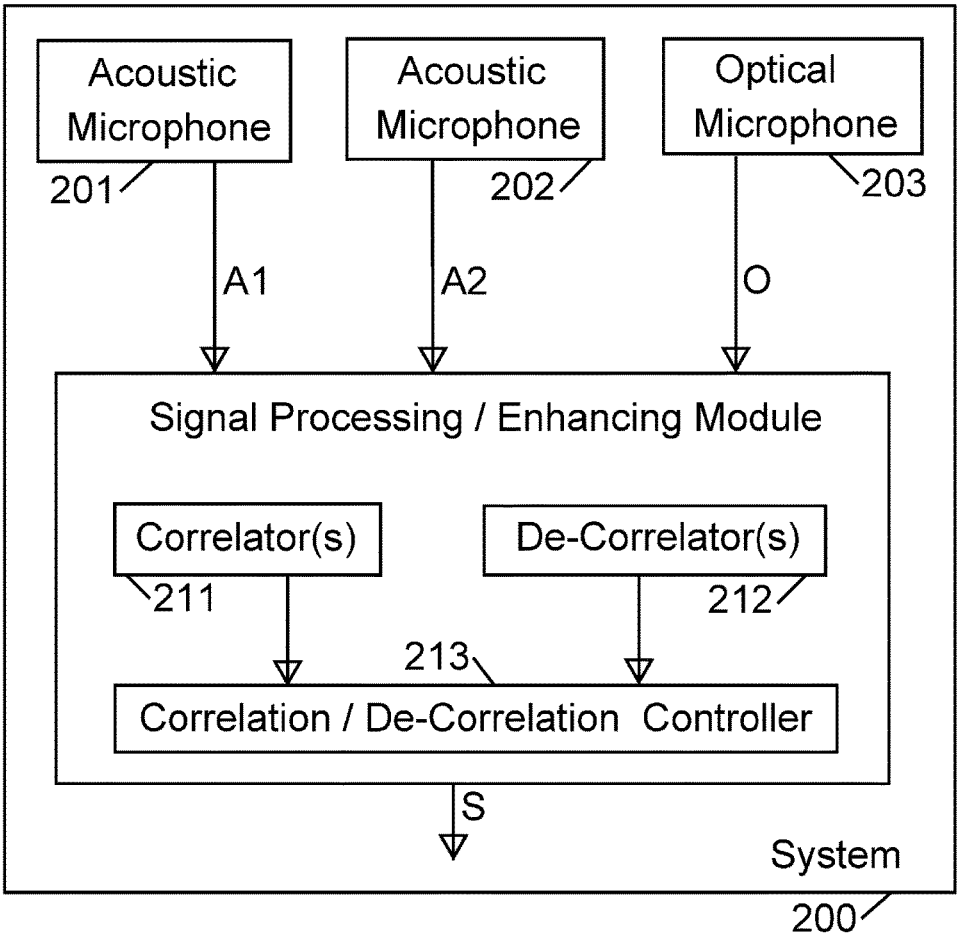
FIG. 2 is a schematic block-diagram illustration of another system, in accordance with some demonstrative embodiments of the present invention.

Reference is made to FIG. 2, which is a schematic block-diagram illustration of a system 200 in accordance with some demonstrative embodiments of the present invention. Optionally, system 200 may be a particular implementation of system 100 of FIG. 1.

System 200 may comprise a plurality of acoustic microphones; for example, a first acoustic microphone 201 able to generate a first signal A1 corresponding to the audio captured by the first acoustic microphone 201; and a second acoustic microphone 202 able to generate a second signal A2 corresponding to the audio captured by the second acoustic microphone 202. System 200 may further comprise one or more optical microphones; for example, an optical microphone 203 aimed towards an area-of-interest, able to generate a signal O corresponding to the optical feedback captured by the optical microphone 203.

A signal processing/enhancing module 210 may receive as input: the first signal A1 of the first acoustic microphone 201, and the second signal A2 of the second acoustic microphone, and the signal O from the optical microphone. The signal processing/enhancing module 210 may comprise one or more correlator(s) 211, and/or one or more decorrelators 212; which may perform one or more, or a set or series or sequence of, correlation operations and/or decorrelation operations, on the received signals or on some of them or on combination(s) of them, as described herein, based on correlation/decorrelation logic implemented by a correlation/decorrelation controller 213; in order to achieve a particular goal, for example, to reduce noise(s) from acoustic signal(s), to improve or enhance or clean the acoustic signal(s), to distinguish or separate or differentiate among sources of acoustic signals or among speakers, to distinguish or separate or differentiate between a speaker (or multiple speakers) and noise or background noise or ambient noise, to operate as digital filter on one or more of the received signals, and/or to perform other suitable operations.

The signal processing/enhancing module 210 may output an enhanced reduced-noise signal S, which may be utilized for such purposes and/or for other purposes, by other units or modules or components of system 200, or by units or components or modules which may be external to (and/or remote from) system 200.

The present invention may comprise a system having a Driver (TX) and/or Receiver (RX) that are optimized or improved or enhanced for Self-Mix application(s).

The Applicants have realized that the following types of sources of noise may adversely affect the performance of optical microphones or laser microphones.

The Applicants have realized that TX noise appears at the output, as amplitude noise and/or as frequency noise; and both of them may be critical to the system performance. Sources of TX noise, as identified by the Applicants, may include: (1) Shut noise, proportional to square root of ILD and the BW of the driver; (2) Additional noise due to electromagnetic coupling of other noisy signals; proportional to the driver's BW; (3) sampling noise, if the AC signal is digitally calculated and later transforms to an analog signal via DAC, the sampling noise being proportional to the DAC clock and/or to the effective number of bits; and/or (4) low frequency noise, such as 1/f noise or flicker noise.

The Applicants have realized that RX noise reduces the Signal to Noise Ratio (SNR) of the signal, thus lowering the system's performance; and such RX noise may include: (1) Electronic noise, such as the Johnson-Nyquist noise of the amplifier and resistors; (2) Shut noise, proportional to the square root of DC current at the PD together with the DC cancellation current; this may be a dominant noise source in optical microphones or laser microphones; (3) Additional noise due to electromagnetic coupling of other noisy signals; proportional to the receiver BW; (4) Laser Relative Intensity Noise (RIN); (5) Laser extra noise during Self-Mix; and/or (6) low frequency noise, such as 1/f noise or flicker noise.

In some embodiments of the present invention, a laser microphone or an optical microphone may use Self-Mix (SM) interferometric method, in which the laser light is back-scattered from the target into the laser; introducing wavelength and optical power change which are proportional to the target distance and speed. In addition, in order to decrease the sensitivity to noise, the laser current is modulated using a specific waveform.

In accordance with the present invention, the amplifier (TX) and receiver (RX) may be structured to enable such activities while reducing additional noise which would be inherent to system otherwise.

Figure 3A:
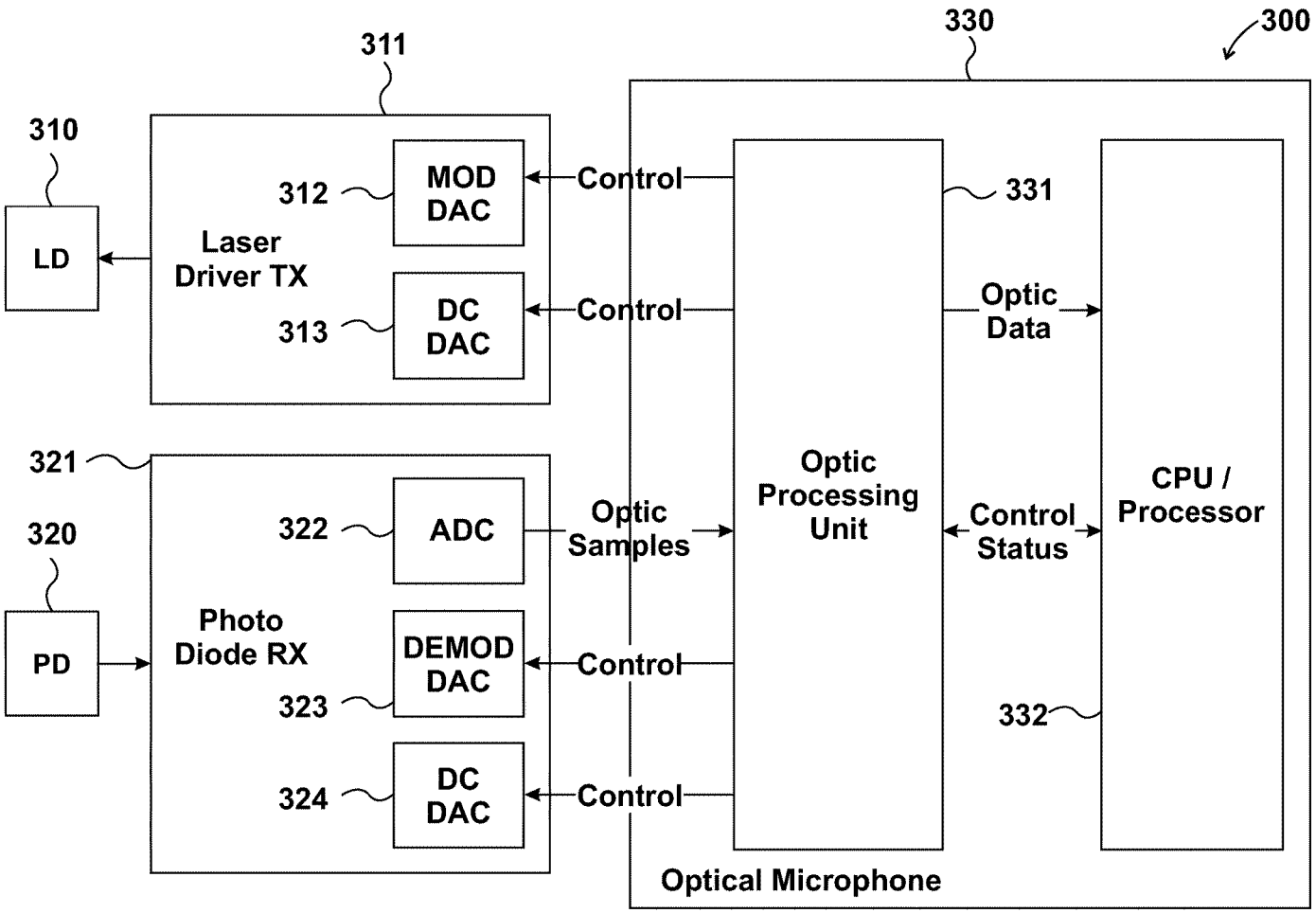
FIG. 3A is a schematic block-diagram illustration of another system, in accordance with some demonstrative embodiments of the present invention.

FIG. 3A is a schematic block-diagram illustration of a system 300, in accordance with some demonstrative embodiments of the present invention.

System 300 may comprise, for example: a laser diode (LD) 310, associated with a laser driver TX 311; and a photo diode (PD) 320, associated with a photo diode receiver (RX) 321. An optical microphone 330 may comprise an optics processing unit 331, and a Central Processing Unit (CPU/Processor 332. The optics processing unit 331 may transfer optic data to the CPU/Processor 332. The optics processing unit 331 and the CPU/Processor 332 may exchange control data and/or status data.

The laser driver TX 311 may comprise one or more Digital to Analog Converter (DAC) units or modules; for example, a Modulation DAC 312 (or Modulator DAC), and a Direct Current (DC) DAC 313, both may receive control signals from the optics processing unit 331, and may produce voltage. The DC DAC 313 may produce DC voltage; whereas the Modulation DAC 312 may produce AC voltage.

The photo diode RX 321 may comprise one or more DAC units or modules; for example, a De-Modulation DAC 323 (or De-Modulator DAC), which may receive control signals from the optics processing unit 331, and a DC DAC 324, which may receive control signals from the optics processing unit 331. The DC DAC 324 may produce DC voltage; whereas the De-Modulation DAC 323 may produce AC voltage. The photo diode RX 321 may further comprise an Analog to Digital Converter (ADC) 322, which may transfer optic samples to the optic processing unit 331.

Figure 3B:
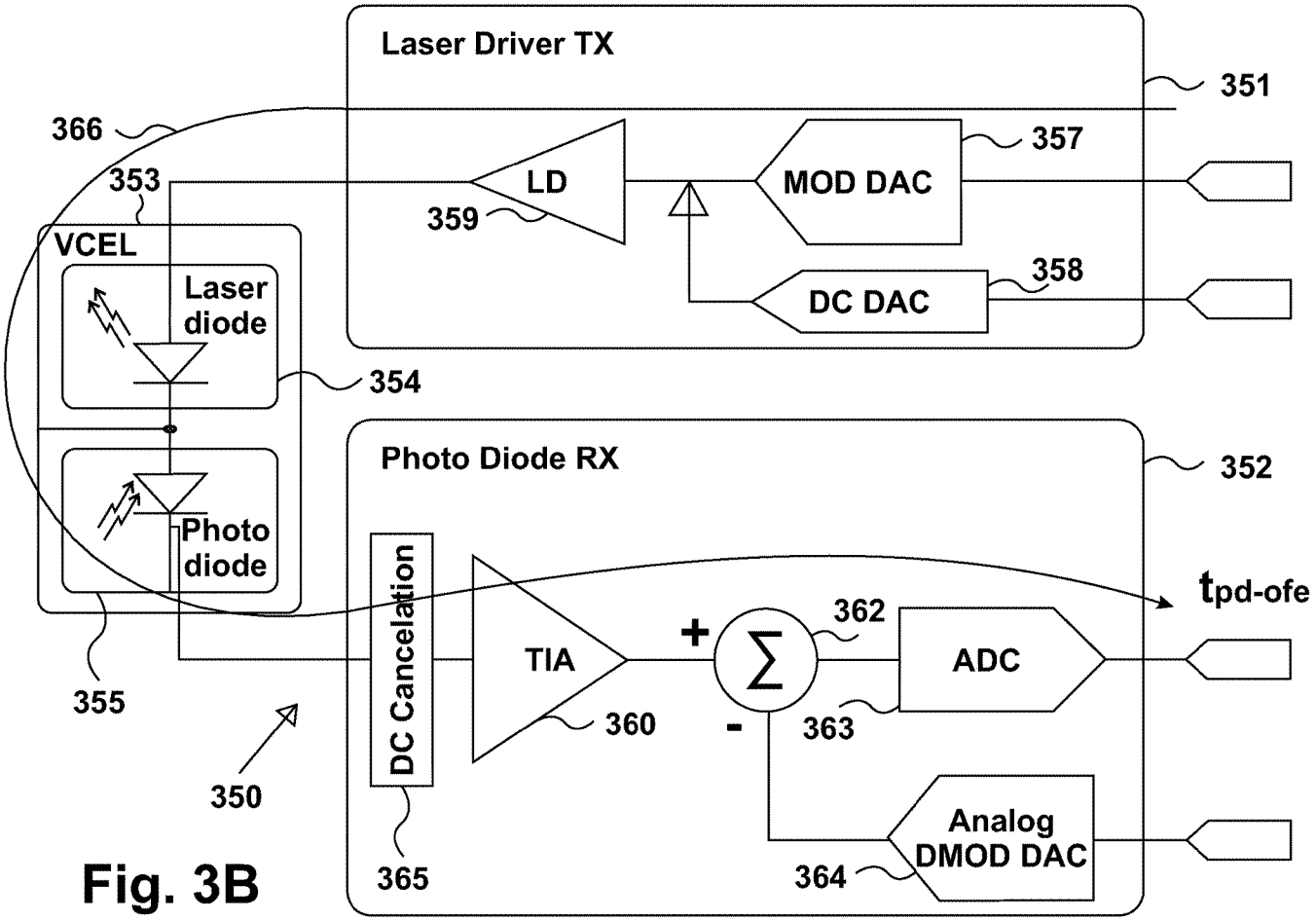
FIG. 3B is a schematic block-diagram illustration of an optical front-end, in accordance with some demonstrative embodiments of the present invention.

Reference is made to FIG. 3B, which is a schematic block-diagram illustration of an optical front-end (OFE) 350, in accordance with some demonstrative embodiments of the present invention. For demonstrative purposes, depicted are the Laser Diode TX 351; the Photo Diode RX 352; and a vertical-cavity surface-emitting laser (VCSEL) 353 having a laser diode 354 and a photo diode 355. A curved arrow 366 schematically indicates a flow or transmission flow or operational flow of these components. The laser diode TX 351 may comprise a Modulated DAC 357 and a DC DAC 358; and their combined outputs are fed to a laser driver 359. In the photo diode RX 352, prior to TIA amplification by the TIA amplifier 360, a DC Cancelation Unit 360 operates to remove or reduce or cancel the DC component; for example, by using a resistor and/or an opposite direction current source (e.g., optionally utilizing a DC DAC there), and/or by using a high-pass filter and/or a low-pass filter there, or by other suitable DC component canceling mechanisms. A summing unit 362 may subtract the output of an Analog De-Modulator DAC 364 from the output of the TIA amplifier 360, and may provide output to an ADC 363.

Figure 4A:
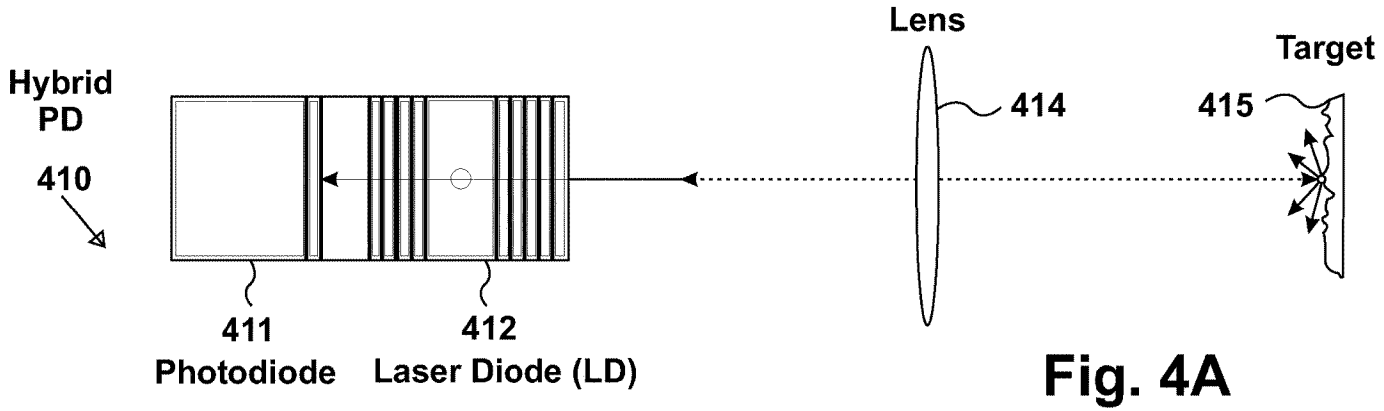
FIG. 4A is a schematic block-diagram illustration of a hybrid photo-diode, in accordance with some demonstrative embodiments of the present invention.

Reference is made to FIG. 4A, which is a schematic block-diagram illustration of a hybrid photo-diode (Hybrid PD) 410, in accordance with some demonstrative embodiments of the present invention. The hybrid photo-diode 410 is a monolithic or integrated unit that includes therein both a photodiode 411 and a laser diode 412, which may receive reflected optical signal from a target 415 through a lens 414 (or other optics element(s)).

Figure 4B:
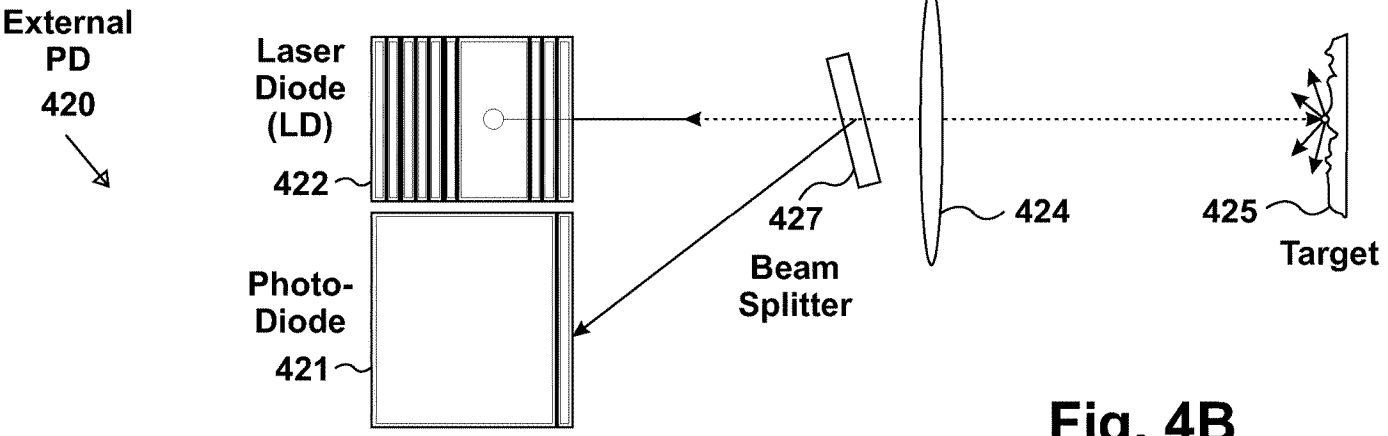
FIG. 4B is a schematic block-diagram illustration of an external photo-diode system, in accordance with some demonstrative embodiments of the present invention.

Reference is made to FIG. 4B, which is a schematic block-diagram illustration of an external photo-diode system 420, in accordance with some demonstrative embodiments of the present invention. The hybrid photo-diode 420 is a non-monolithic unit that includes therein two separate units, which are a photodiode 421 and a laser diode 422; a beam splitter 427 may be used to split or divide the optical signal(s) that are sent to (or received from) a target 425 though a lens 424 (or other optics element(s)).

Figure 4C:
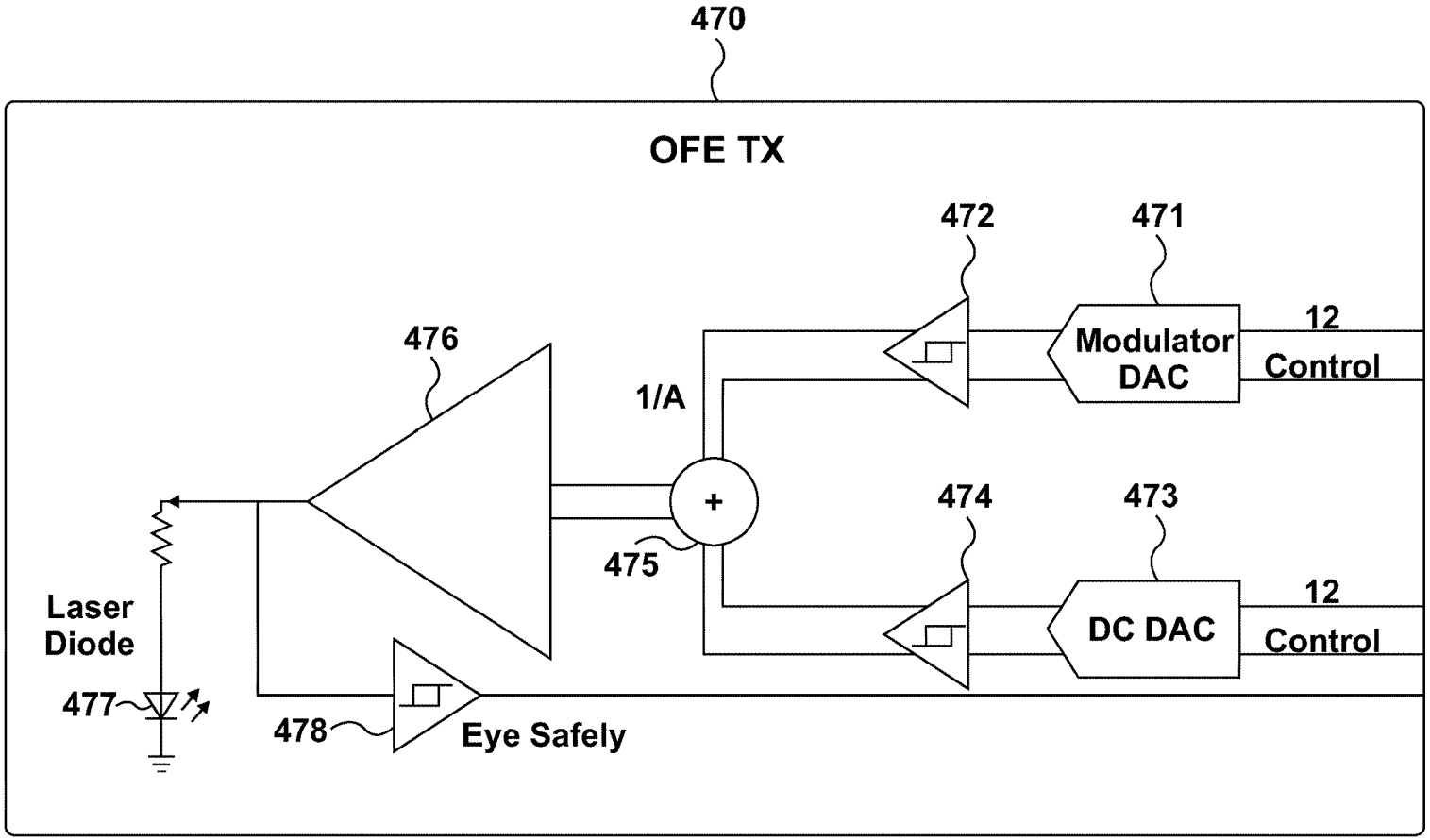
FIG. 4C is a schematic block-diagram illustration of an optical front end, in accordance with some demonstrative embodiments of the present invention.

Reference is made to FIG. 4C, which is a schematic block-diagram illustration of an Optical Front-End (OFE) 470 of laser driver Tx, in accordance with some demonstrative embodiments of the present invention. For example, the OFE 470 may comprise a 12-bit Modulator DAC 471 able to receive a control signal and 12-bit data; and a Low Pass Filter (LPF) 472, for example, a 70 or 72 KHz bandwidth Low Pass Filter first order. OFE 470 may further comprise a 12-bit DC DAC 473, able to receive a control signal and 12-bit data; and a Low Pass Filter (LPF) 474, for example, a 4 KHz bandwidth Low Pass Filter first order. Outputs of the Low Pass Filters 472 and 474, which operate as low-cut filters that reduce bandwidth, may be combined or added by adder 475 (or a summing unit or combining unit), which also performs Attenuation (e.g., by using one or more resistors) by a factor of "A" (e.g., indicated as "1/A" in the circuit), and may be fed to a 70 or 72 KHz bandwidth optical laser diode driver 476 with current violation sensor and disconnect option; and its output may be fed to a laser diode 477 (e.g., optionally after passing through a resistor, for eye safety implementation), as well to an eye safety unit 478 able to ensure that only eye-safe laser is generated and used (e.g., the eye safety unit 478 utilizing a comparator that turns-off or deactivates the laser if the current is greater than a threshold value).

In a demonstrative TX configuration in accordance with the present invention, DC and AC components of the drive current are separately constructed each with different bandwidth (BW) values, and are then summed (e.g., using a summing unit or other adder or combiner) with the AC component attenuated (e.g., utilizing an attenuator or resistor(s), and/or optionally utilizing a high-pass filter and/or a low-pass filter, or other "cut" filter). It is noted that in order to not over-crowd the drawing, FIG. 4C shows in certain places a single line of input (e.g., 12-bit data); however, other types of data may be used (e.g., 10-bit data, 16-bit data, or the like), and optionally, two lines of data may be used to implement a differential circuit (e.g., two paths, for plus and minus).

The following discussion relates to the TX configuration.

The input drive current to the laser is combined of the DC drive current and superimposed on it the AC modulation. The modulation waveform may be sinusoidal saw-tooth or triangle. Non-symmetrical waveforms may also be utilized.

For utilizing waveforms with sharp slopes (e.g., triangle waveform), large band-width (BW) may be needed. The wider the BW, the less distorted signal is obtained. Some systems may utilize 6 (odd) harmonies, which for 6 KHz gives BW>72 KHz. However, the Applicants have realized that as the BW is increased, higher noise is introduced into the laser input, and this is non-desired since the optical microphone may be very sensitive to such noise.

The present invention may generate the drive current to the laser as a combination of two components, the DC and the AC; each of them with different BW. The result is that the noise in the DC part (with very low BW) may be substantially small. The two components are then combined with relative attenuation of the AC component; for example, according to the formula:

$$I_{Laser}=I_{DC}+I_{AC}/A$$

In the above equation, for example, A may be equal to 10 as the attenuation factor; other suitable values or ratios may be used (e.g., 2 or 4 or 5 or 6 or 7 or 8 or 10 or 12 or 16, or the like), and may further allow to achieve noise reduction.

Some embodiments of the present invention may optionally distort the modulated triangle signal by pre-enhancing higher harmonies of the wave, while keeping the BW of the AC driver low; such that the resulting input to the laser will be again an un-distorted triangle wave.

In a demonstrative example, a Low Pass Filter is having one pole at 6 KHz is utilized, to result in attenuation of the n harmonies of a 6 KHz signal by an attenuation factor which may be calculated by using the following formula:

$$H(n) = \frac{1}{\sqrt{1+n^2}}$$

Using a 6 KHz triangular wave modulation as an example, the harmonies in the Fourier expansion of this signal are proportional to 1/n, where "n" is the number of harmony.

At the input of the LPF, a signal may be created with harmonies according to the following formula:

$$A(n)=\sqrt{1+n^2}/n$$

The above provides a signal with harmonies proportional to 1/n at the output of the LPF, which is the triangular signal that the circuit utilizes as a low-noise architecture.

Some embodiments of the present invention may optionally implement the following approach: Instead of lowering the BW as a means of lowering the noise, some embodiments may use a filter which is specific to the input signal (e.g., triangle), such as a comb filter that passes only the relevant harmonies, but attenuates everything else.

The following discussion relates to the RX configuration.

The Applicants have realized that an optical microphone or laser microphone may be sensitive to noise density but not to the total noise power, and thus the BW of the RX is not necessarily critical for the quality of performance of an optical microphone or laser microphone.

Figure 5A:
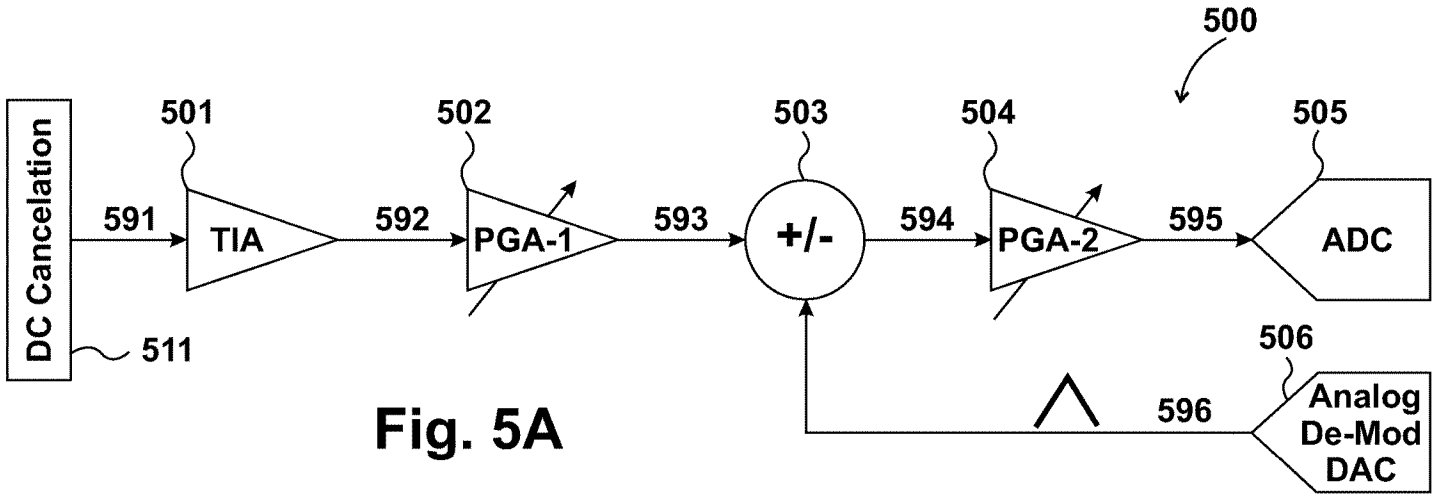
FIG. 5A is a schematic block diagram illustration demonstrating photo-diode receiver configuration with hardware demodulation before analog-to-digital conversion, in accordance with some embodiments of the present invention.

Reference is made to FIG. 5A, which is a schematic block diagram illustration demonstrating RX configuration with hardware demodulation before the ADC, in accordance with some embodiments of the present invention.

In accordance with some demonstrative embodiments of the present invention, the RX may include hardware demodulation. The signal that comes out of the Photo-Diode (PD) combines three parts: DC, Modulation, and SM signal, as demonstrated in FIG. 5C. In a demonstrative embodiment, as shown in circuit 500 of FIG. 5A, the DC part is reduced or is removed or canceled by a DC Cancellation Unit 511, for example, using a current source with opposite direction or using a resistor in serial (or in series) with an adaptive bias source, before Trans-Impedance Amplification (TIA) by the TIA amplifier 501 and before digitization of the signal. The TIA amplifier 501 is transforming the input current to voltage, which at this stage (points 592 and 593 in FIG. 5A; before and after programmable gain amplifier (PGA) 502) combines only two components, the modulation and the SM signal. Removing the modulation part at this point (just before digitization), enables further increasing of the modulation amplitude without exceeding the analog-to-digital (A2D) dynamic range. The output of the PGA 502 is combined or summed, via a summing unit 503, with the triangle-shaped output of Analog De-Modulator DAC 506; and their sum is transferred to PGA 504, and then to the ADC 505. The features of the present invention enable a substantial increase in the optical microphone performance, via at least one or more of the following parameters (or some of them, or all of them): (a) the maximal measured speed, (b) the minimal measured speed, (c) detection range, e.g., the minimal distance and maximal distance in which the optical microphone is still preforming.

Figure 5B:
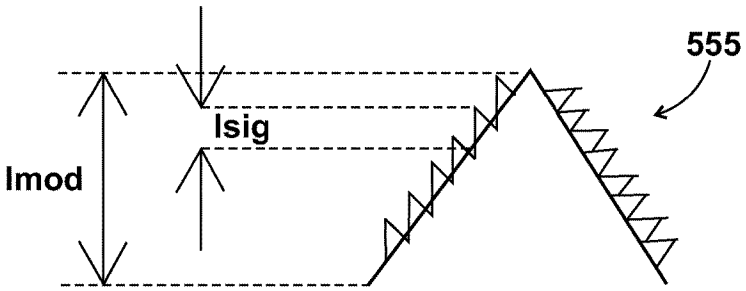
FIG. 5B is a schematic representation of a signal whose Direct Current (DC) component may be removed or canceled or reduced, in accordance with some demonstrative embodiments of the present invention.

Reference is made to FIG. 5B, which is a schematic representation of a signal 555, demonstrating the DC-removed signal (e.g., as it reaches point 593 of FIG. 5A), in accordance with some demonstrative embodiments of the present invention. Other suitable signal patterns or signal types may be used, or may be DC-removed or DC-canceled or DC-reduced.

Figure 5C:
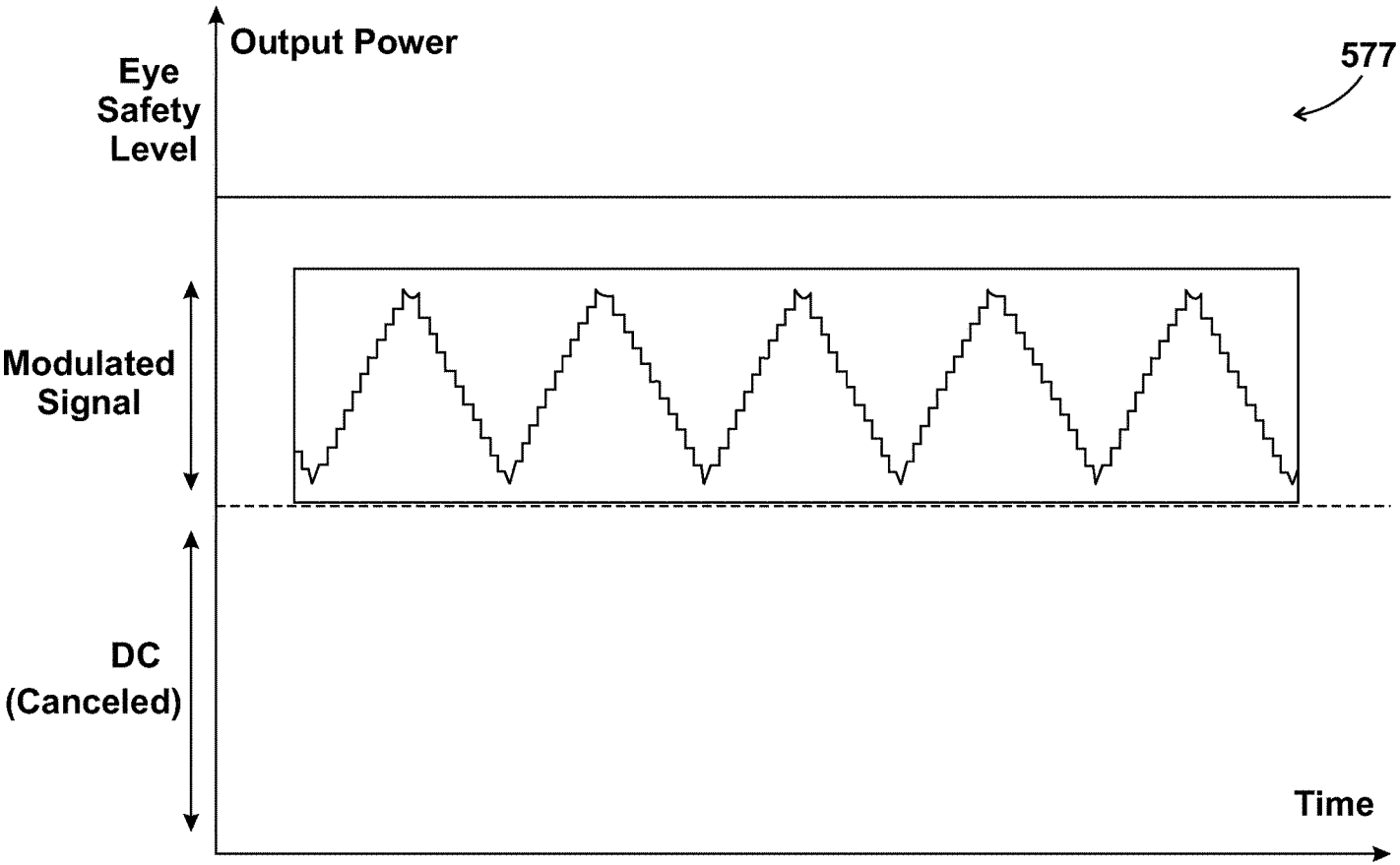
FIG. 5C is a schematic representation of another signal whose Direct Current (DC) component may be removed or canceled or reduced, in accordance with some demonstrative embodiments of the present invention.

Reference is made to FIG. 5C, which is a schematic representation of a signal 577 whose DC component may be removed or canceled or reduced, in accordance with some demonstrative embodiments of the present invention. Other suitable signal patterns or signal types may be used, or may be DC-removed or DC-canceled or DC-reduced.

In accordance with some demonstrative embodiments of the present invention, the laser-based microphone or optical microphone may utilize a laser beam having wavelength that allows the smallest or minimal loss of measurable signal, or may utilize a laser having wavelength that allows the smallest of minimal round-trip cavity loss. For every different location in the area-of-interest or the target-area, a different wavelength is selected and utilized by the laser module. Accordingly, the intensity of the laser may also change, depending on the particular location or point being targeted. The modification of laser wavelength may thus be an integrated process, similarly to the way that modification of laser intensity is. Additionally, since laser current modulation is utilized, the modification may be larger due to the alternating heating/cooling or rise/fall in temperature.

Some embodiments of the present invention may strengthen or improve the laser signal, by utilizing this modification of the laser wavelength; which may be done, for example, by utilizing a filter. For example, if the laser target moves from Point1 to Point2, the laser wavelength may change from A to B; and thus, if a filter is added, and the filter filters-out B and lets A pass, the strength of the laser on the photo-diode (PD) may be modified by 100% when the target moves from Point1 to Point2.

The present invention may utilize one or more mechanisms for modifying, setting, increasing and/or decreasing the laser wavelength; for example: (1) movement of the target location; (2) modulation of the current of the laser; (3) modification of the environmental temperature.

Some embodiments may ensure or may utilize a relation or a match or correspondence between the frequency response of the filter and the wavelength of the laser. In some embodiments, a filter may be used and the filter may have fixed cyclicity which may be related to the Free Spectral Range (FSR) of the component used. In some embodiments, the coefficient of modification of the wavelength of the filter may correspond or match to that of the laser, by utilizing similar materials for both components. Additionally, an algorithm may be used to modify the current in order to achieve dynamic maximization of the output signal.

The terms "laser" or "laser transmitter" as used herein may comprise or may be, for example, a stand-alone laser transmitter, a laser transmitter unit, a laser generator, a component able to generate and/or transmit a laser beam or a laser ray, a laser drive, a laser driver, a laser transmitter associated with a modulator, a combination of laser transmitter with modulator, a combination of laser driver or laser drive with modulator, or other suitable component able to generate and/or transmit a laser beam.

The term "acoustic microphone" as used herein, may comprise one or more acoustic microphone(s) and/or acoustic sensor(s); or a matrix or array or set or group or batch or arrangement of multiple such acoustic microphones and/or acoustic sensors; or one or more sensors or devices or units or transducers or converters (e.g., an acoustic-to-electric transducer or converter) able to convert sound into an electrical signal; a microphone or transducer that utilizes electromagnetic induction (e.g., a dynamic microphone) and/or capacitance change (e.g., a condenser microphone) and/or piezoelectricity (e.g., a piezoelectric microphones) in order to produce an electrical signal from air pressure variations; a microphone that may optionally be connected to, or may be associated with or may comprise also, a pre-amplifier or an amplifier; a carbon microphone; a carbon button microphone; a button microphone; a ribbon microphone; an electret condenser microphone; a capacitor microphone; a magneto-dynamic microphone; a dynamic microphone; an electrostatic microphone; a Radio Frequency (RF) condenser microphone; a crystal microphone; a piezo microphone or piezoelectric microphone; and/or other suitable types of audio microphones, acoustic microphones and/or sound-capturing microphones.

The term "laser microphone" as used herein, may comprise, for example: one or more laser microphone(s) or sensor(s); one or more laser-based microphone(s) or sensor(s); one or more optical microphone(s) or sensor(s); one or more microphone(s) or sensor(s) that utilize coherent electromagnetic waves; one or more optical sensor(s) or laser-based sensor(s) that utilize vibrometry, or that comprise or utilize a vibrometer; one or more optical sensor(s) and/or laser-based sensor(s) that comprise a self-mix module, or that utilize self-mixing interferometry measurement technique (or feedback interferometry, or induced-modulation interferometry, or backscatter modulation interferometry), in which a laser beam is reflected from an object, back into the laser, and the reflected light interferes with the light generated inside the laser, and this causes changes in the optical and/or electrical properties of the laser, and information about the target object and the laser itself may be obtained by analyzing these changes.

The terms "vibrating" or "vibrations" or "vibrate" or similar terms, as used herein, refer and include also any other suitable type of motion, and may not necessarily require vibration or resonance per se; and may include, for example, any suitable type of motion, movement, shifting, drifting, slanting, horizontal movement, vertical movement, diagonal movement, one-dimensional movement, two-dimensional movement, three-dimensional movement, or the like.

In some embodiments of the present invention, which may optionally utilize a laser microphone, only "safe" laser beams or sources may be used; for example, laser beam(s) or source(s) that are known to be non-damaging to human body and/or to human eyes, or laser beam(s) or source(s) that are known to be non-damaging even if accidently hitting human eyes for a short period of time. Some embodiments may utilize, for example, Eye-Safe laser, infra-red laser, infra-red optical signal(s), low-strength laser, and/or other suitable type(s) of optical signals, optical beam(s), laser beam(s), infra-red beam(s), or the like. It would be appreciated by persons of ordinary skill in the art, that one or more suitable types of laser beam(s) or laser source(s) may be selected and utilized, in order to safely and efficiently implement the system and method of the present invention. In some embodiments, optionally, a human speaker or a human user may be requested to wear sunglasses or protective eye-gear or protective goggles, in order to provide additional safety to the eyes of the human user which may occasionally be "hit" by such generally-safe laser beam, as an additional precaution.

In some embodiments which may utilize a laser microphone or optical microphone, such optical microphone (or optical sensor) and/or its components may be implemented as (or may comprise) a Self-Mix module; for example, utilizing a self-mixing interferometry measurement technique (or feedback interferometry, or induced-modulation interferometry, or backscatter modulation interferometry), in which a laser beam is reflected from an object, back into the laser. The reflected light interferes with the light generated inside the laser, and this causes changes in the optical and/or electrical properties of the laser. Information about the target object and the laser itself may be obtained by analyzing these changes. In some embodiments, the optical microphone or laser microphone operates to remotely detect or measure or estimate vibrations of the skin (or the surface) of a face-point or a face-region or a face-area of the human speaker (e.g., mouth, mouth-area, lips, lips-area, cheek, nose, chin, neck, throat, ear); and/or to remotely detect or measure or estimate the direct changes in skin vibrations; rather than trying to measure indirectly an effect of spoken speech on a vapor that is exhaled by the mouth of the speaker, and rather than trying to measure indirectly an effect of spoken speech on the humidity or relative humidity or gas components or liquid components that may be produced by the mouth due to spoken speech.

The present invention may be utilized in, or with, or in conjunction with, a variety of devices or systems that may benefit from noise reduction and/or speech enhancement; for example, a smartphone, a cellular phone, a cordless phone, a video conference system or device, a tele-conference system or device, an audio/video camera, a web-camera or web-cam, a landline telephony system, a cellular telephone system, a voice-messaging system, a Voice-over-IP system or network or device, a vehicle, a vehicular dashboard, a vehicular audio system or microphone, a navigation device or system, a vehicular navigation device or system, a mapping or route-guidance device or system, a vehicular route-guidance or device or system, a dictation system or device, Speech Recognition (SR) device or module or system, Automatic Speech Recognition (ASR) module or device or system, a speech-to-text converter or conversion system or device, a laptop computer, a desktop computer, a notebook computer, a tablet, a phone-tablet or "phablet" device, a gaming device, a gaming console, a wearable device, a smart-watch, a Virtual Reality (VR) device or helmet or glasses or headgear, an Augmented Reality (AR) device or helmet or glasses or headgear, an Internet of Things (IoT) device or appliance, an Internet-connected device or appliance, a wireless-connected device or appliance, a device or system or module that utilizes speech-based commands or audio commands, a device or system that captures and/or records and/or processes and/or analyzes audio signals and/or speech and/or acoustic signals, and/or other suitable systems and devices.

Some embodiments of the present invention may provide or may comprise a laser-based device or apparatus or system, a laser-based microphone or sensor, a laser microphone or sensor, an optical microphone or sensor, a hybrid acoustic-optical sensor or microphone, a combined acoustic-optical sensor or microphone, and/or a system that comprises or utilizes one or more of the above.

Figure 6:
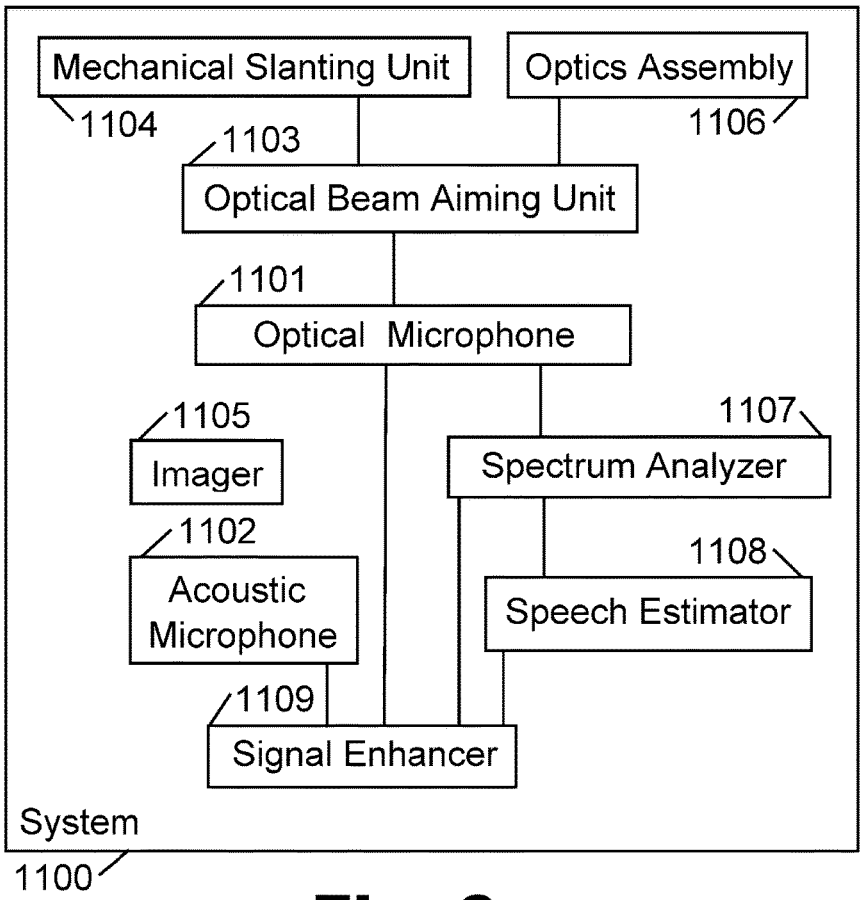
FIG. 6 is a schematic block-diagram illustration of a system, in accordance with some demonstrative embodiments of the present invention.

Reference is made to FIG. 6, which is a schematic block-diagram illustration of a system 1100, in accordance with some demonstrative embodiments of the present invention.

System 1100 may comprise, for example, an optical microphone 1101 able to transmit an optical beam (e.g., a laser beam) towards a target (e.g., a face of a human speaker), and able to capture and analyze the optical feedback that is reflected from the target, particularly from vibrating regions or vibrating face-regions or face-portions of the human speaker (or other suitable body parts, such as throat or neck). The optical microphone 1101 may be or may comprise or may utilize a Self-Mix (SM) chamber or unit, an interferometry chamber or unit, an interferometer, a vibrometer, a targeted vibrometer, or other suitable component, able to analyze the spectrum of the received optical signal with reference to the transmitted optical beam, and able to remotely estimate the audio or speech or utterances generated by the target (e.g., the human speaker).

Optionally, system 1100 may comprise an acoustic microphone 1102 or an audio microphone, which may capture audio. Optionally, the analysis results of the optical feedback may be utilized in order to improve or enhance or filter the captured audio signal; and/or to reduce or cancel noise(s) from the captured audio signal. Optionally, system 1100 may be implemented as a hybrid acoustic-and-optical sensor, or as a hybrid acoustic-and-optical sensor. In other embodiments, system 1100 need not necessarily comprise an acoustic microphone. In yet other embodiments, system 1100 may comprise optical microphone 1102 and may not comprise any acoustic microphones, but may operate in conjunction with an external or a remote acoustic microphone.

System 1100 may further comprise an optical beam aiming unit 1103 (or tilting unit, or slanting unit, or positioning unit, or targeting unit, or directing unit), for example, implemented as a laser beam directing unit or aiming unit or other unit or module able to direct a transmitted optical beam (e.g., a transmitted laser beam) towards the target, and/or able to fine-tune or modify the direction of such optical beam or laser beam. The directing or alignment of the optical beam or laser beam, towards the target, may be performed or achieved by using one or more suitable mechanisms.

In a first example, the optical microphone 1101 may be fixedly mounted or attached or located at a first location or point (e.g., on a vehicular dashboard; on a frame of a screen of a laptop computer), and may generally point or be directed towards an estimated location or a general location of a human speaker that typically utilizes such device (e.g., aiming or targeting an estimated general location of a head of a driver in a vehicle; or aiming or targeting an estimated general location of a head of a laptop computer user); based on a fixed or pre-mounted angular slanting or positioning (e.g., performed by a maker of the vehicular dashboard or vehicle, or by the maker of the laptop computer).

In a second example, the optical microphone may be mounted on a wall of a lecture hall; and may be fixedly pointing or aiming its laser beam or its optical beam towards a general location of a stage or a podium in that lecture hall, in order to target a human speaker who is a lecturer.

In a third example, a motor or engine or robotic arm or other mechanical slanting unit 1104 may be used, in order to align or slant or tilt the direction of the optical beam or laser beam of the optical microphone, towards an actual or an estimated location of a human speaker; optionally via a control interface that allows an administrator to command the movement or the slanting of the optical microphone towards a desired target (e.g., similar to the manner in which an optical camera or an imager or a video-recording device may be moved or tilted via a control interface, a pan-tilt-zoom (PTZ) interface, a robotic arm, or the like).

In a fourth example, an imager 1105 or camera may be used in order to capture images or video of the surrounding of the optical microphone; and a face-recognition module or image-recognition module or a face-identifying module or other Computer Vision algorithm or module may be used in order to analyze the captured images or video and to determine the location of a human speaker (or a particular, desired, human speaker), and to cause the slanting or aiming or targeting or re-aligning of the optical beam to aim towards the identified human speaker. In a fifth example, a human speaker may be requested to wear or to carry a particular tag or token or article or object, having a pre-defined shape or color or pattern which is not typically found at random (e.g., tag or a button showing a green triangle within a yellow square); and an imager or camera may scan an area or a surrounding of system 1100, may analyze the images or video to detect or to find the pre-defined tag, and may aim the optical microphone towards the tag, or towards a pre-defined or estimated offset distance from that tag (e.g., a predefined K degrees of slanting upwardly or vertically relative to the detected tag, if the human speaker is instructed to carry the tag or to wear the tag on his jacket pocket).

In a sixth example, an optics assembly 1106 or optics arrangement (e.g., one or more mirrors, flat mirrors, concave mirrors, convex mirrors, lenses, prisms, beam-splitters, focusing elements, diffracting elements, diffractive elements, condensing elements, and/or other optics elements or optical elements) may be utilized in order to direct or aim the optical beam or laser beam towards a known or estimated or general location of a target or a speaker or a human face. The optics assembly may be fixedly mounted in advance (e.g., within a vehicle, in order to aim or target a vehicular optical sensor towards a general-location of a driver face), or may be dynamically adjusted or moved or tilted or slanted based on real-time information regarding the actual or estimated location of the speaker or his head (e.g., determined by using an imager, or determined by finding a Signal to Noise Ratio (SNR) value that is greater than a threshold value).

In a seventh example, the optical microphone may move or may "scan" a target area (e.g., by being moved or slanted via the mechanical slanting unit 1104); and may remain at, or may go-back to, a particular direction in which the Signal to Noise Ratio (SNR) value was the maximal, or optimal, or greater than a threshold value.

In an eighth example, particularly if the human speaker is moving on a stage or moving in a room, or moves his face to different directions, the human speaker may be requested or required to stand at a particular spot or location in order to enable the system to efficiently work (e.g., similarly to the manner in which a singer or a performer is required to stand in proximity to a wired acoustic microphone which is mounted on a microphone stand); and/or the human speaker may be requested or required to look to a particular direction or to move his face to a particular direction (e.g., to look directly towards the optical microphone) in order for the system to efficiently operate (e.g., similar to the manner in which a singer or a performer may be requested to look at a camera or a video-recorder, or to put his mouth in close proximity to an acoustic microphone that he holds).

Other suitable mechanisms may be used to achieve or to fine-tune aiming, targeting and/or aligning of the optical beam with the desired target.

It is clarified that the optical microphone and/or the system of the present invention, need not be continuously aligned with the target or the human speaker, and need not necessarily "hit" the speaker continuously with laser beam or optical beam. Rather, in some embodiments, the present invention may operate only during time-periods in which the optical beam or laser beam actually "hits" the face of the speaker, or actually causes reflection of optical feedback from vibrating face-regions of the human speaker. In some embodiments, the system may operate or may efficiently operate at least during time period(s) in which the laser beam(s) or the optical signal(s) actually hit (or reach, or touch) the face or the mouth or the mouth-region of a speaker; and not in other time-periods or time-slots. In some embodiments, the system and/or method need not necessarily provide continuous speech enhancement or continuous noise reduction or continuous speech detection; but rather, in some embodiments the speech enhancement and/or noise reduction and/or speech detection may be achieved in those specific time-periods in which the laser beam(s) actually hit the face of the speaker and cause a reflection of optical feedback from vibrating surfaces or face-regions. In some embodiments, the system may operate only during such time periods (e.g., only a few minutes out of an hour; or only a few seconds out of a minute) in which such actual "hit" of the laser beam with the face-region is achieved. In other embodiments, continuous or substantially-continuous noise reduction and/or speech enhancement may be achieved; for example, in a vehicular system in which the laser beam is directed towards the location of the head or the face of the driver.

In accordance with the present invention, the optical microphone 1101 may comprise a self-mix chamber or unit or self-mix interferometer or a targeted vibrometer, and may utilize reflected optical feedback (e.g., reflected feedback of a transmitted laser beam) in order to remotely measure or estimate vibrations of the facial skin or facial-regions head-regions of a human speaker, utilizing a spectrum analyzer 1107 in order to analyze the optical feedback with reference to the transmitted optical feedback, and utilizing a speech estimator unit 1108 to estimate or extract a signal that corresponds to speech or audio that is generated or uttered by that human speaker.

Optionally, system 1100 may comprise a signal enhancer 1109, which may enhance, filter, improve and/or clean the acoustic signal that is captured by acoustic microphone 1102, based on output generated by the optical microphone 1101. For example, system 1100 may dynamically generate and may dynamically apply, to the acoustic signal captured by the acoustic microphone 1102, a digital filter which may be dynamically constructed by taking into account the output of the optical microphone 1101, and/or by taking into account an analysis of the optical feedback or optical signal(s) that are reflected back from the face of the human speaker.

System 1100 may further comprise any, or some, or all, of the components and/or systems that are depicted in any of FIGS. 1-5C, and/or that are discussed with reference to FIGS. 1-5C and/or above and/or herein.

The present invention may be utilized in conjunction with one or more types of acoustic samples or data samples, or a voice sample or voice print, which may not necessarily be merely an acoustic recording or raw acoustic sounds, and/or which may not necessarily be a cleaned or digitally-cleaned or filtered or digitally-filtered acoustic recording or acoustic data. For example, the present invention may utilize, or may operate in conjunction with, in addition to or instead of the other samples or data as described above, one or more of the following: (a) the speech signal, or estimated or detected speech signal, as determined by the optical microphone 1101 based on an analysis of the self-mixed optical signals; (b) an acoustic sample as captured by the acoustic microphone 1102, by itself and/or in combination with the speech signal estimated by the optical microphone 1101; (c) an acoustic sample as captured by the acoustic microphone 1102 and as cleaned or digitally-cleaned or filtered or digitally-filtered or otherwise digitally-adjusted or digitally-modified based on the speech signal estimated by the optical microphone 1101; (d) a voice print or speech sample which is acquired and/or produced by utilizing one or more biometric algorithms or sub-modules, such as a Neural Network module or a Hidden Markov Model (HMM) unit, which may utilize both the acoustic signal and the optical signal (e.g., the self-mixed signals of the optical microphone 1101) in order to extract more data and/or more user-specific characteristics from utterances of the human speaker.

Some embodiments of the present invention may comprise an optical microphone or laser microphone or a laser-based microphone, or optical sensor or laser sensor or laser-based sensor, which utilizes multiple lasers or multiple laser beams or multiple laser transmitters, in conjunction with a single laser drive component and/or a single laser receiver component, thereby increasing or improving the efficiency of self-mix techniques or module or chamber (or self-mix interferometry techniques or module or chamber) utilized by such optical or laser-based microphone or sensor.

In some embodiments of the present invention, which may optionally utilize a laser microphone or optical microphone, the laser beam or optical beam may be directed to an estimated general-location of the speaker; or to a pre-defined target area or target region in which a speaker may be located, or in which a speaker is estimated to be located. For example, the laser source may be placed inside a vehicle, and may be targeting the general location at which a head of the driver is typically located. In other embodiments, a system may optionally comprise one or more modules that may, for example, locate or find or detect or track, a face or a mouth or a head of a person (or of a speaker), for example, based on image recognition, based on video analysis or image analysis, based on a pre-defined item or object (e.g., the speaker may wear a particular item, such as a hat or a collar having a particular shape and/or color and/or characteristics), or the like. In some embodiments, the laser source(s) may be static or fixed, and may fixedly point towards a general-location or towards an estimated-location of a speaker. In other embodiments, the laser source(s) may be non-fixed, or may be able to automatically move and/or change their orientation, for example, to track or to aim towards a general-location or an estimated-location or a precise-location of a speaker. In some embodiments, multiple laser source(s) may be used in parallel, and they may be fixed and/or moving.

In some demonstrative embodiments of the present invention, which may optionally utilize a laser microphone or optical microphone, the system and method may efficiently operate at least during time period(s) in which the laser beam(s) or the optical signal(s) actually hit (or reach, or touch) the face or the mouth or the mouth-region of a speaker. In some embodiments, the system and/or method need not necessarily provide continuous speech enhancement or continuous noise reduction; but rather, in some embodiments the speech enhancement and/or noise reduction may be achieved in those time-periods in which the laser beam(s) actually hit the face of the speaker. In other embodiments, continuous or substantially-continuous noise reduction and/or speech enhancement may be achieved; for example, in a vehicular system in which the laser beam is directed towards the location of the head or the face of the driver.

The system(s) of the present invention may optionally comprise, or may be implemented by utilizing suitable hardware components and/or software components; for example, processors, processor cores, Central Processing Units (CPUs), Digital Signal Processors (DSPs), circuits, Integrated Circuits (ICs), controllers, memory units, registers, accumulators, storage units, input units (e.g., touch-screen, keyboard, keypad, stylus, mouse, touchpad, joystick, trackball, microphones), output units (e.g., screen, touch-screen, monitor, display unit, audio speakers), acoustic microphone(s) and/or sensor(s), optical microphone(s) and/or sensor(s), laser or laser-based microphone(s) and/or sensor(s), wired or wireless modems or transceivers or transmitters or receivers, GPS receiver or GPS element or other location-based or location-determining unit or system, network elements (e.g., routers, switches, hubs, antennas), and/or other suitable components and/or modules. The system(s) of the present invention may optionally be implemented by utilizing co-located components, remote components or modules, "cloud computing" servers or devices or storage, client/server architecture, peer-to-peer architecture, distributed architecture, and/or other suitable architectures or system topologies or network topologies.

Some embodiments of the present invention may comprise, or may utilize, or may be utilized in conjunction with, one or more elements, units, devices, systems and/or methods that are described in U.S. Pat. No. 7,775,113, titled "Sound sources separation and monitoring using directional coherent electromagnetic waves", which is hereby incorporated by reference in its entirety.

Some embodiments of the present invention may comprise, or may utilize, or may be utilized in conjunction with, one or more elements, units, devices, systems and/or methods that are described in U.S. Pat. No. 8,286,493, titled "Sound sources separation and monitoring using directional coherent electromagnetic waves", which is hereby incorporated by reference in its entirety.

Some embodiments of the present invention may comprise, or may utilize, or may be utilized in conjunction with, one or more elements, units, devices, systems and/or methods that are described in U.S. Pat. No. 8,949,118, titled "System and method for robust estimation and tracking the fundamental frequency of pseudo periodic signals in the presence of noise", which is hereby incorporated by reference in its entirety.

Some embodiments of the present invention may comprise, or may utilize, or may be utilized in conjunction with, one or more elements, units, devices, systems and/or methods that are described in U.S. Pat. No. 9,344,811, titled "System and method for detection of speech related acoustic signals by using a laser microphone", which is hereby incorporated by reference in its entirety.

In accordance with embodiments of the present invention, calculations, operations and/or determinations may be performed locally within a single device, or may be performed by or across multiple devices, or may be performed partially locally and partially remotely (e.g., at a remote server) by optionally utilizing a communication channel to exchange raw data and/or processed data and/or processing results.

Although portions of the discussion herein relate, for demonstrative purposes, to wired links and/or wired communications, some embodiments are not limited in this regard, but rather, may utilize wired communication and/or wireless communication; may include one or more wired and/or wireless links; may utilize one or more components of wired communication and/or wireless communication; and/or may utilize one or more methods or protocols or standards of wireless communication.

Some embodiments may be implemented by using a special-purpose machine or a specific-purpose device that is not a generic computer, or by using a non-generic computer or a non-general computer or machine. Such system or device may utilize or may comprise one or more components or units or modules that are not part of a "generic computer" and that are not part of a "general purpose computer", for example, cellular transceivers, cellular transmitter, cellular receiver, GPS unit, location-determining unit, accelerometer(s), gyroscope(s), device-orientation detectors or sensors, device-positioning detectors or sensors, or the like.

Some embodiments may be implemented as, or by utilizing, an automated method or automated process, or a machine-implemented method or process, or as a semi-automated or partially-automated method or process, or as a set of steps or operations which may be executed or performed by a computer or machine or system or other device.

Some embodiments may be implemented by using code or program code or machine-readable instructions or machine-readable code, which may be stored on a non-transitory storage medium or non-transitory storage article (e.g., a CD-ROM, a DVD-ROM, a physical memory unit, a physical storage unit), such that the program or code or instructions, when executed by a processor or a machine or a computer, cause such processor or machine or computer to perform a method or process as described herein. Such code or instructions may be or may comprise, for example, one or more of: software, a software module, an application, a program, a subroutine, instructions, an instruction set, computing code, words, values, symbols, strings, variables, source code, compiled code, interpreted code, executable code, static code, dynamic code; including (but not limited to) code or instructions in high-level programming language, low-level programming language, object-oriented programming language, visual programming language, compiled programming language, interpreted programming language, C, C++, C#, Java, JavaScript, SQL, Ruby on Rails, Go, Cobol, Fortran, ActionScript, AJAX, XML, JSON, Lisp, Eiffel, Verilog, Hardware Description Language (HDL, BASIC, Visual BASIC, Matlab, Pascal, HTML, HTML5, CSS, Perl, Python, PHP, machine language, machine code, assembly language, or the like.

Discussions herein utilizing terms such as, for example, "processing", "computing", "calculating", "determining", "establishing", "analyzing", "checking", "detecting", "measuring", or the like, may refer to operation(s) and/or process (es) of a processor, a computer, a computing platform, a computing system, or other electronic device or computing device, that may automatically and/or autonomously manipulate and/or transform data represented as physical (e.g., electronic) quantities within registers and/or accumulators and/or memory units and/or storage units into other data or that may perform other suitable operations.

The terms "plurality" and "a plurality", as used herein, include, for example, "multiple" or "two or more". For example, "a plurality of items" includes two or more items.

References to "one embodiment", "an embodiment", "demonstrative embodiment", "various embodiments", "some embodiments", and/or similar terms, may indicate that the embodiment(s) so described may optionally include a particular feature, structure, or characteristic, but not every embodiment necessarily includes the particular feature, structure, or characteristic. Furthermore, repeated use of the phrase "in one embodiment" does not necessarily refer to the same embodiment, although it may. Similarly, repeated use of the phrase "in some embodiments" does not necessarily refer to the same set or group of embodiments, although it may.

As used herein, and unless otherwise specified, the utilization of ordinal adjectives such as "first", "second", "third", "fourth", and so forth, to describe an item or an object, merely indicates that different instances of such like items or objects are being referred to; and does not intend to imply as if the items or objects so described must be in a particular given sequence, either temporally, spatially, in ranking, or in any other ordering manner.

Some embodiments may be used in, or in conjunction with, various devices and systems, for example, a Personal Computer (PC), a desktop computer, a mobile computer, a laptop computer, a notebook computer, a tablet computer, a server computer, a handheld computer, a handheld device, a Personal Digital Assistant (PDA) device, a handheld PDA device, a tablet, an on-board device, an off-board device, a hybrid device, a vehicular device, a non-vehicular device, a mobile or portable device, a consumer device, a non-mobile or non-portable device, an appliance, a wireless communication station, a wireless communication device, a wireless Access Point (AP), a wired or wireless router or gateway or switch or hub, a wired or wireless modem, a video device, an audio device, an audio-video (A/V) device, a wired or wireless network, a wireless area network, a Wireless Video Area Network (WVAN), a Local Area Network (LAN), a Wireless LAN (WLAN), a Personal Area Network (PAN), a Wireless PAN (WPAN), or the like.

Some embodiments may be used in conjunction with one way and/or two-way radio communication systems, cellular radio-telephone communication systems, a mobile phone, a cellular telephone, a wireless telephone, a Personal Communication Systems (PCS) device, a PDA or handheld device which incorporates wireless communication capabilities, a mobile or portable Global Positioning System (GPS) device, a device which incorporates a GPS receiver or transceiver or chip, a device which incorporates an RFID element or chip, a Multiple Input Multiple Output (MIMO) transceiver or device, a Single Input Multiple Output (SIMO) transceiver or device, a Multiple Input Single Output (MISO) transceiver or device, a device having one or more internal antennas and/or external antennas, Digital Video Broadcast (DVB) devices or systems, multi-standard radio devices or systems, a wired or wireless handheld device, e.g., a Smartphone, a Wireless Application Protocol (WAP) device, or the like.

Some embodiments may comprise, or may be implemented by using, an "app" or application which may be downloaded or obtained from an "app store" or "applications store", for free or for a fee, or which may be pre-installed on a computing device or electronic device, or which may be otherwise transported to and/or installed on such computing device or electronic device.

In some embodiments of the present invention, a system includes a laser microphone comprising: a self-mix interferometry unit, (i) to transmit via a laser transmitter at least one outgoing laser beam towards a face of a human speaker, and (ii) to receive an optical feedback signal reflected from the face of the human speaker, and (iii) to generate an optical self-mix signal by self-mixing interferometry of the at least one outgoing laser beam and the received optical feedback signal; wherein the self-mix interferometry unit comprises a laser-diode and a photo-diode; wherein the laser-diode is associated with a laser driver TX; wherein the photo-diode is associated with a photodiode receiver RX; wherein at least one of the laser driver TX and the photodiode receiver RX, implements integrally a mechanism or an integral circuit or integrated circuitry for reducing noises.

In some embodiments, laser driver TX comprises: a Direct Current (DC) Digital-to-Analog Converter (DAC) to generate a Direct Current (DC) having a first bandwidth; a Modulator DAC to separately generate an Alternating Current (AC) having a second, different, bandwidth; wherein the laser driver TX generates a drive current to the laser-diode, by utilizing (i) said Direct Current having the first bandwidth, and also (ii) said Alternating Current having the second, different, bandwidth.

In some embodiments, the laser driver TX comprises: a Direct Current (DC) Digital-to-Analog Converter (DAC) to generate a Direct Current (DC) having a first bandwidth; a Modulator DAC to separately generate an Alternating Current (AC) having a second, different, bandwidth; a summing unit to combine (i) said Direct Current having the first bandwidth, and (ii) said Alternating Current having the second, different, bandwidth; wherein the laser driver TX utilizes output of said summing unit, to generate a drive current supplied to the laser-diode.

In some embodiments, the laser driver TX comprises: a Direct Current (DC) Digital-to-Analog Converter (DAC) to generate a Direct Current (DC) having a first bandwidth; a Modulator DAC to separately generate an Alternating Current (AC) having a second, different, bandwidth; an attenuator to attenuate said Alternating Current and to produce attenuated Alternating Current; a summing unit to combine (i) said Direct Current having the first bandwidth, and (ii) said attenuated Alternating Current having the second, different, bandwidth; wherein the laser driver TX utilizes output of said summing unit, to generate a drive current supplied to the laser-diode.

In some embodiments, the laser driver TX comprises: a Direct Current (DC) Digital-to-Analog Converter (DAC) to generate a Direct Current (DC) having a first bandwidth; a Modulator DAC to separately generate an Alternating Current (AC) having a second, different, bandwidth; an attenuator to attenuate said Alternating Current and to produce attenuated Alternating Current, wherein the attenuator comprises at least one of: (I) a resistor, (II) an opposite-direction current; a summing unit to combine (i) said Direct Current having the first bandwidth, and (ii) said attenuated Alternating Current having the second, different, bandwidth; wherein the laser driver TX utilizes output of said summing unit, to generate a drive current supplied to the laser-diode.

In some embodiments, the laser driver TX comprises: a Direct Current (DC) Digital-to-Analog Converter (DAC) to generate a Direct Current (DC) having a first bandwidth; a Modulator DAC to separately generate an Alternating Current (AC) having a second, different, bandwidth; an attenuator to attenuate said Alternating Current and to produce attenuated Alternating Current, wherein the attenuator comprises a cut filter; a summing unit to combine (i) said Direct Current having the first bandwidth, and (ii) said attenuated Alternating Current having the second, different, bandwidth; wherein the laser driver TX utilizes output of said summing unit, to generate a drive current supplied to the laser-diode.

In some embodiments, the laser driver TX comprises: a Direct Current (DC) Digital-to-Analog Converter (DAC) to generate a Direct Current (DC) having a first bandwidth; a Modulator DAC to separately generate an Alternating Current (AC) having a second, different, bandwidth; an attenuator to attenuate said Alternating Current and to produce attenuated Alternating Current, wherein the attenuator comprises a cut filter; a summing unit to combine (i) said Direct Current having the first bandwidth, and (ii) said attenuated Alternating Current having the second, different, bandwidth; wherein said attenuator and said summing unit are an integrated unit; wherein the laser driver TX utilizes output of said summing unit, to generate a drive current supplied to the laser-diode.

In some embodiments, a ratio of (i) the first bandwidth of the Direct Current, to (ii) the second bandwidth of the Alternating Current, is smaller than 1/4.

In some embodiments, a ratio of (i) the first bandwidth of the Direct Current, to (ii) the second bandwidth of the Alternating Current, is smaller than 1/8.

In some embodiments, the first bandwidth of the Direct Current is in the range of 3.80 to 4.40 KHz; and wherein the second bandwidth of the Alternating Current is in the range of 42 to 46 KHz.

In some embodiments, the first bandwidth of the Direct Current is in the range of 3.0 to 5.0 KHz; and the second bandwidth of the Alternating Current is in the range of 69 to 76 KHz.

In some embodiments, a ratio of (i) the first bandwidth of the Direct Current, to (ii) the second bandwidth of the attenuated Alternating Current, is smaller than 1/5.

In some embodiments, a ratio of (i) the first bandwidth of the Direct Current, to (ii) the second bandwidth of the attenuated Alternating Current, is smaller than 1/9.

In some embodiments, the first bandwidth of the Direct Current is in the range of 3.75 to 4.50 KHz; and wherein the second bandwidth of the attenuated Alternating Current is in the range of 41 to 47 KHz.

In some embodiments, the attenuator comprises a Low Pass Filter (LPF) that provides an attenuation factor of:

$$H(n) = \frac{1}{\sqrt{1+n^2}}$$

wherein harmonies in a Fourier expansion of the attenuated signal are proportional to 1/n; wherein "n" is the number of harmony; wherein an input of the LPF receives an input having harmonies according to the following formula:

$$A(n)=\sqrt{1+n^2}/n$$

In some embodiments, the attenuator comprises a Low Pass Filter (LPF) that provides an attenuation factor of: H (n)

wherein harmonies in a Fourier expansion of the required signal are F(n), wherein "n" is the number of harmony;

wherein an input node of the LPF receives an input having harmonies according to the following formula:

$$A(n)=F(n)/H(n)$$

wherein the harmonies at an output node of the LPF correspond to the required signal A(n).

In some embodiments, the photo-diode receiver comprises a hardware demodulation unit to perform hardware-based signal demodulation prior to Analog-to-Digital Conversion (ADC).

In some embodiments, the photo-diode receiver comprises a Direct Current (DC) cancellation unit to remove a Direct Current component of an output signal of said photo-diode receiver.

In some embodiments, the photo-diode receiver comprises a Direct Current (DC) cancellation unit to remove a Direct Current component of an output signal of said photo-diode receiver, by utilizing a current source with opposite direction prior to performing Trans-Impedance Amplification (TIA).

In some embodiments, the photo-diode receiver comprises a Direct Current (DC) cancellation unit to remove a Direct Current component of an output signal of said photo-diode receiver, by utilizing a resistor, prior to performing Trans-Impedance Amplification (TIA).

In some embodiments, the photo-diode receiver comprises a Trans-Impedance Amplification (TIA) unit to amplify a signal that consists of (i) self-mixed signal component, and (ii) modulation component, wherein said signal already excludes any Direct Current (DC) component prior to entering said Trans-Impedance Amplification (TIA) unit.

In some embodiments, the photo-diode receiver removes a Direct Current component of an output signal of said photo-diode receiver, prior to digitization of said output signal.

In some embodiments, the laser driver TX comprises: a Direct Current (DC) Digital-to-Analog Converter (DAC) to generate a Direct Current (DC) having a first bandwidth; a Modulator DAC to separately generate an Alternating Current (AC) having a second, different, bandwidth; a summing unit to combine (i) said Direct Current having the first bandwidth, and (ii) said Alternating Current having the second, different, bandwidth; wherein the laser driver TX utilizes output of said summing unit, to generate a drive current supplied to the laser-diode; and wherein the photo-diode receiver comprises a Direct Current (DC) cancellation unit to remove a Direct Current component of an output signal of said photo-diode receiver prior to performing Trans-Impedance Amplification (TIA).

In some embodiments, the system further comprises at least one acoustic microphone; wherein the system is a hybrid acoustic-and-optical sensor.

In some embodiments, the system further comprises at least one acoustic microphone; wherein the system is a hybrid acoustic-and-optical sensor which is comprised in a device selected from the group consisting of: a laptop computer, a smartphone, a tablet, a portable electronic device, a vehicular audio system.

Some embodiments of the present invention may comprise an optical microphone, laser-based microphone, and laser microphone having reduced-noise components of low-noise components. For example, a laser microphone comprises a laser-diode associated with a low-noise laser driver TX; and a photo-diode associated with a low-noise photo-diode receiver. The low-noise laser driver TX supplies a drive current which is a combination of a Direct Current component having a first bandwidth, and an attenuated version of an Alternating Current component having a second, different, bandwidth. Additionally or alternatively, the low-noise photo-diode receiver utilizes hardware-based demodulation of the analog signal, and operates to remove a Direct Current component of its output signal prior to digitization.

Functions, operations, components and/or features described herein with reference to one or more embodiments of the present invention, may be combined with, or may be utilized in combination with, one or more other functions, operations, components and/or features described herein with reference to one or more other embodiments of the present invention. The present invention may thus comprise any possible or suitable combinations, re-arrangements, assembly, re-assembly, or other utilization of some or all of the modules or functions or components that are described herein, even if they are discussed in different locations or different chapters of the above discussion, or even if they are shown across different drawings or multiple drawings.

While certain features of some demonstrative embodiments of the present invention have been illustrated and described herein, various modifications, substitutions, changes, and equivalents may occur to those skilled in the art. Accordingly, the claims are intended to cover all such modifications, substitutions, changes, and equivalents.

The invention claimed is:

1. A system comprising:

a laser microphone comprising:

a self-mix interferometry unit, (i) to transmit via a laser transmitter at least one outgoing laser beam towards a human speaker, and (ii) to receive an optical feedback signal reflected from the human speaker, and (iii) to generate an optical self-mix signal by self-mixing interferometry of the at least one outgoing laser beam and the received optical feedback signal;

wherein the self-mix interferometry unit comprises a laser-diode and a photo-diode;

wherein the laser-diode is associated with a laser driver TX;

wherein the photo-diode is associated with a photodiode receiver;

wherein at least one of the laser driver TX and the photodiode receiver, implements integrally a mechanism for reducing noises;

wherein the laser driver TX comprises:

a Direct Current (DC) Digital-to-Analog Converter (DAC) to generate a Direct Current (DC) having a first bandwidth;

a Modulator DAC to separately generate an Alternating Current (AC) having a second, different, bandwidth;

wherein the laser driver TX generates a drive current to the laser-diode, by utilizing (i) said Direct Current having the first bandwidth, and also (ii) said Alternating Current having the second, different, bandwidth.

2. The system of claim 1, wherein the laser driver TX comprises:

a summing unit to combine (i) said Direct Current having the first bandwidth, and (ii) said Alternating Current having the second, different, bandwidth;

wherein the laser driver TX utilizes output of said summing unit, to generate said drive current supplied to the laser-diode.

3. The system of claim 1, wherein the laser driver TX comprises:

an attenuator to attenuate said Alternating Current and to produce attenuated Alternating Current;

a summing unit to combine (i) said Direct Current having the first bandwidth, and (ii) said attenuated Alternating Current having the second, different, bandwidth;

wherein the laser driver TX utilizes output of said summing unit, to generate said drive current supplied to the laser-diode.

4. The system of claim 1, wherein the laser driver TX comprises:

an attenuator to attenuate said Alternating Current and to produce attenuated Alternating Current, wherein the attenuator comprises at least one of: (I) a resistor, (II) an opposite-direction current;

a summing unit to combine (i) said Direct Current having the first bandwidth, and (ii) said attenuated Alternating Current having the second, different, bandwidth;

wherein the laser driver TX utilizes output of said summing unit, to generate said drive current supplied to the laser-diode.

5. The system of claim 1, wherein the laser driver TX comprises:

an attenuator to attenuate said Alternating Current and to produce attenuated Alternating Current, wherein the attenuator comprises a cut filter;

a summing unit to combine (i) said Direct Current having the first bandwidth, and (ii) said attenuated Alternating Current having the second, different, bandwidth;

wherein the laser driver TX utilizes output of said summing unit, to generate said drive current supplied to the laser-diode.

6. The system of claim 1, wherein the laser driver TX comprises:

an attenuator to attenuate said Alternating Current and to produce attenuated Alternating Current, wherein the attenuator comprises a cut filter;

a summing unit to combine (i) said Direct Current having the first bandwidth, and (ii) said attenuated Alternating Current having the second, different, bandwidth;

wherein said attenuator and said summing unit are an integrated unit;

wherein the laser driver TX utilizes output of said summing unit, to generate said drive current supplied to the laser-diode.

7. The system of claim 1, wherein a ratio of (i) the first bandwidth of the Direct Current, to (ii) the second bandwidth of the Alternating Current, is smaller than 1/4.

8. The system of claim 1, wherein a ratio of (i) the first bandwidth of the Direct Current, to (ii) the second bandwidth of the Alternating Current, is smaller than 1/8.

9. The system of claim 1, wherein the first bandwidth of the Direct Current is in the range of 3.80 to 4.40 KHz; and wherein the second bandwidth of the Alternating Current is in the range of 42 to 46 KHz.

10. The system of claim 1, wherein the first bandwidth of the Direct Current is in the range of 3.0 to 5.0 KHz; and wherein the second bandwidth of the Alternating Current is in the range of 69 to 76 KHz.

11. The system of claim 2, wherein a ratio of (i) the first bandwidth of the Direct Current, to (ii) the second bandwidth of the attenuated Alternating Current, is smaller than 1/5.

12. The system of claim 2, wherein a ratio of (i) the first bandwidth of the Direct Current, to (ii) the second bandwidth of the attenuated Alternating Current, is smaller than 1/9.

13. The system of claim 2, wherein the first bandwidth of the Direct Current is in the range of 3.75 to 4.50 KHz; and wherein the second bandwidth of the attenuated Alternating Current is in the range of 41 to 47 KHz.

14. The system of claim 2, wherein the attenuator comprises a Low Pass Filter (LPF) that provides an attenuation factor of:

$$H(n) = \frac{1}{\sqrt{1+n^2}}$$

wherein harmonies in a Fourier expansion of the attenuated signal are proportional to 1/n, wherein "n" is the number of harmony;

wherein an input of the LPF receives an input having harmonies according to the following formula:

$$A(n)=\sqrt{1+n^2}/n$$

15. The system of claim 2, wherein the attenuator comprises a Low Pass Filter (LPF) that provides an attenuation factor of:

$$H(n)$$

wherein harmonies in a Fourier expansion of the required signal are F(n), wherein "n" is the number of harmony;

wherein an input node of the LPF receives an input having harmonies according to the following formula:

$$A(n)=F(n)/H(n)$$

wherein the harmonies at an output node of the LPF correspond to the required signal A(n).

16. The system of claim 1, wherein the photo-diode receiver comprises a hardware demodulation unit to perform hardware-based signal demodulation prior to Analog-to-Digital Conversion (ADC).

17. A system comprising:

a laser microphone comprising:

a self-mix interferometry unit, (i) to transmit via a laser transmitter at least one outgoing laser beam towards a human speaker, and (ii) to receive an optical feedback signal reflected from the human speaker, and (iii) to generate an optical self-mix signal by self-mixing interferometry of the at least one outgoing laser beam and the received optical feedback signal;

wherein the self-mix interferometry unit comprises a laser-diode and a photo-diode;

wherein the laser-diode is associated with a laser driver TX;

wherein the photo-diode is associated with a photodiode receiver;

wherein at least one of the laser driver TX and the photodiode receiver, implements integrally a mechanism for reducing noises;

wherein the photo-diode receiver comprises a Direct Current (DC) cancellation unit to remove a Direct Current component of an output signal of said photo-diode receiver.

18. The system of claim 1, wherein the photo-diode receiver comprises a Direct Current (DC) cancellation unit to remove a Direct Current component of an output signal of said photo-diode receiver, by utilizing a current source with opposite direction prior to performing Trans-Impedance Amplification (TIA).

19. The system of claim 1, wherein the photo-diode receiver comprises a Direct Current (DC) cancellation unit to remove a Direct Current component of an output signal of said photo-diode receiver, by utilizing a resistor, prior to performing Trans-Impedance Amplification (TIA).

20. The system of claim 1, wherein the photo-diode receiver comprises a Trans-Impedance Amplification (TIA) unit to amplify a signal that consists of (i) self-mixed signal component, and (ii) modulation component, wherein said signal already excludes any Direct Current (DC) component prior to entering said Trans-Impedance Amplification (TIA) unit.

21. A system comprising:

a laser microphone comprising:

a self-mix interferometry unit, (i) to transmit via a laser transmitter at least one outgoing laser beam towards a human speaker, and (ii) to receive an optical feedback signal reflected from the human speaker, and (iii) to generate an optical self-mix signal by self-mixing interferometry of the at least one outgoing laser beam and the received optical feedback signal;

wherein the self-mix interferometry unit comprises a laser-diode and a photo-diode;

wherein the laser-diode is associated with a laser driver TX;

wherein the photo-diode is associated with a photodiode receiver;

wherein at least one of the laser driver TX and the photodiode receiver, implements integrally a mechanism for reducing noises;

wherein the photo-diode receiver removes a Direct Current component of an output signal of said photo-diode receiver, prior to digitization of said output signal.

22. The system of claim 1, wherein the laser driver TX comprises:

a summing unit to combine (i) said Direct Current having the first bandwidth, and (ii) said Alternating Current having the second, different, bandwidth;

wherein the laser driver TX utilizes output of said summing unit, to generate said drive current supplied to the laser-diode;

wherein the photo-diode receiver comprises a Direct Current (DC) cancellation unit to remove a Direct Current component of an output signal of said photo-diode receiver prior to performing Trans-Impedance Amplification (TIA).

23. The system of claim 1, further comprising at least one acoustic microphone; wherein the system is a hybrid acoustic-and-optical sensor.

24. The system of claim 17, further comprising at least one acoustic microphone; wherein the system is a hybrid acoustic-and-optical sensor which is comprised in a device selected from the group consisting of: a laptop computer, a smartphone, a tablet, a portable electronic device, a vehicular audio system.

* * * * *